US006758795B2

(12) United States Patent
Barber

(10) Patent No.: US 6,758,795 B2
(45) Date of Patent: Jul. 6, 2004

(54) ADJUSTABLE WATER-FILLABLE EXERCISE WEIGHTS

(76) Inventor: Stephen Barber, 108 Dorothy St., St. Catharines, Ontario (CA), L2N 6Z4

( * ) Notice: Subject to any disclaimer, the term of this patent is extended or adjusted under 35 U.S.C. 154(b) by 62 days.

(21) Appl. No.: 09/927,774

(22) Filed: Aug. 13, 2001

(65) Prior Publication Data

US 2002/0028734 A1 Mar. 7, 2002

Related U.S. Application Data

(60) Provisional application No. 60/226,690, filed on Aug. 22, 2000.

(51) Int. Cl.[7] ..... A63B 21/072
(52) U.S. Cl. ..... 482/106; 482/50
(58) Field of Search ..... 482/50, 106, 107, 482/108

(56) References Cited

U.S. PATENT DOCUMENTS

| | | | | |
|---|---|---|---|---|
| 2,680,967 A | | 6/1954 | Newman | |
| 2,918,282 A | | 12/1959 | Waterval | |
| 3,231,270 A | * | 1/1966 | Winer | 482/106 |
| 3,836,141 A | | 9/1974 | Franklyn | |
| 4,072,308 A | | 2/1978 | Applegate | |
| 4,153,244 A | | 5/1979 | Tauber, Jr. | |
| 4,531,727 A | | 7/1985 | Pitre | |
| 4,619,453 A | | 10/1986 | Plumridge | |
| 4,695,051 A | | 9/1987 | Jenison | |
| 4,718,663 A | | 1/1988 | Shepherd | |
| 4,720,098 A | | 1/1988 | Gordon | |
| 4,749,188 A | | 6/1988 | Montgomery | |
| 4,854,575 A | | 8/1989 | Wilson et al. | |
| 4,854,576 A | * | 8/1989 | McWain | 482/106 |
| 4,905,992 A | * | 3/1990 | McWain | 482/106 |
| 4,949,955 A | | 8/1990 | Keen | |
| 4,997,184 A | * | 3/1991 | Sherman | 482/108 |
| 5,072,935 A | | 12/1991 | McWain | |
| 5,152,523 A | | 10/1992 | Keen | |
| 5,300,001 A | * | 4/1994 | Sealy | 128/DIG. 15 |
| 5,379,909 A | | 1/1995 | Roark | |
| 5,431,615 A | | 7/1995 | Correll | |
| 5,445,587 A | | 8/1995 | Brown | |
| 5,620,112 A | | 4/1997 | Brown | |
| 5,626,543 A | | 5/1997 | Chen | |
| 5,857,946 A | | 1/1999 | Brown | |
| 6,099,441 A | | 8/2000 | Bonnet | |

* cited by examiner

*Primary Examiner*—Nicholas D. Lucchesi
*Assistant Examiner*—Tam Nguyen
(74) *Attorney, Agent, or Firm*—Dinesh Agarwal, P.C.

(57) ABSTRACT

A readily portable dumbell or barbell for exercising and weight training is provided in which weight units on an elongated handle comprise front and rear end plates interconnected by a collapsible/expandible fluid receptacle in the form of a resilient bellows. The weight unit is lengthened and expanded when fluid is added and is shortened and decreased in volume when fluid is removed. Calibration means are provided for visually indicating the weight of the unit corresponding to the longitudinal spacing between the front and end plates of the unit. In a preferred embodiment, a visually readable measurement of weight is provided by means for a graduated bar insert which extends slidably within the hollow handle of the dumbell or barbell and moves therealong with expansion or contraction of the water-filled bellows.

8 Claims, 3 Drawing Sheets

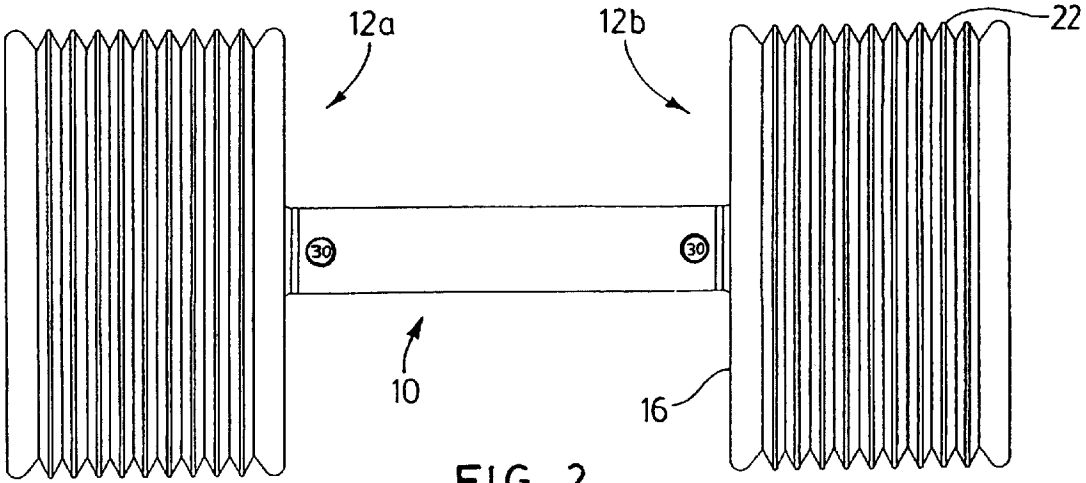
FIG. 2
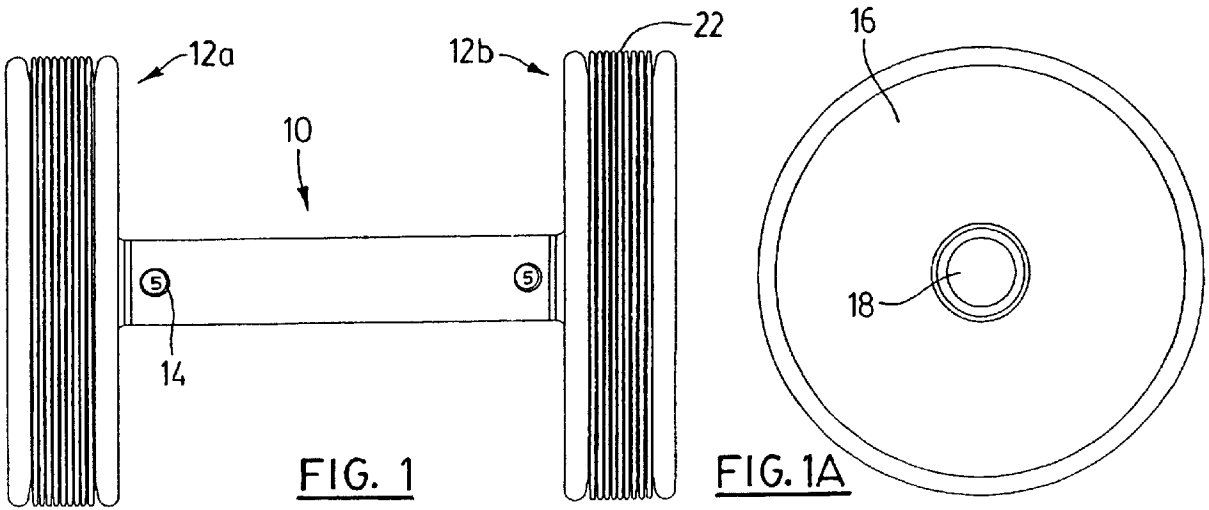
FIG. 1A
FIG. 1

ADJUSTABLE WATER-FILLABLE EXERCISE WEIGHTS

The present application claims priority on prior U.S. Provisional Application Ser. No. 60/226,690, filed Aug. 22, 2000, and which is incorporated herein in its entirety by reference.

BACKGROUND OF THE INVENTION

The present invention relates generally to handheld exercising devices and is more particularly concerned with dumbells or barbells comprising water-fillable bellows-form weights which may be expanded to selected, reversibly lockable positions corresponding to predetermined levels of resistance to lifting of the barbell or dumbell when the weights are filled with water.

The desirability of portable exercise equipment such as "travel dumbells" has long been recognized and several examples are found in the prior art of exercise apparatus which may be adjusted by filling weight reservoirs with fluid to provide variable resistance to lifting, for example, Jenison, U.S. Pat. No. 4,695,051; Sherman, U.S. Pat. No. 4,997,184; Brown, U.S. Pat. No. 5,445,587 and Brown, U.S. Pat. No. 5,857,946.

In any weight training program, it is desired to have a variety of dumbells or barbells in which the end weight portions can be selectively increased by integral increments of, say, 5 lbs. The hand-held exercise devices hitherto provided in the prior art not entirely satisfactory for this purpose, either from the point of view of non-collapsability (i.e. of a fluid refillable exercise apparatus including a fluid filling scale) or of collapsability, but without any readily measurable and reproducible weight increment on adding fluid to the device.

It is a principal object of the invention to provide easily portable and packable dumbell/barbell equipment which can be assembled and reproducibly charged with water to a desired weight. After use, the collapsed and empty end weights can be taken off the bar, packed and carried around in a suitcase or the like.

Accordingly, a traveler having arrived at his hotel room, say, and desirous of carrying out weight lifting exercises in his own room can unobtrusively assemble the dumbell or barbell, fill the weight containers to desired calibrated levels and later empty them and pack the lot away.

SUMMARY OF THE INVENTION

With a view to providing an improved variable resistance dumbell or barbell that achieves this principal object and avoids the shortcomings of similar prior art devices, I have invented a dumbell/barbell arrangement in which each weight is a container for fluid, comprising rigid plate members and a collapsible/expandible receptacle extending between opposing faces of the plate members. Means such as a screw-capped filling port is used for introducing or removing water into the expandible weight unit.

In a preferred embodiment of my invention, each weight unit is a container having a central channel to receive a portion of the crossbar and is expandable in bellows-like fashion along calibrated stopping points on the crossbar of the exercise device, giving a clear visual numerical rendering of the filled weight of each weight container.

Weight lifting equipment according to the present invention is particularly useful for exercising at the beach, where water is readily available and the light weight and portability of the equipment is advantageous. Similarly, the ease of adjustability of the variable weights make them ideal for carrying out a graded workout beside a swimming pool.

The invention may be embodied in the form illustrated in the accompanying drawings, which are by way of example only.

BRIEF DESCRIPTION OF THE DRAWING FIGURES

FIG. 1 is an elevational view of a dumbell according to the present invention, in which the bellows-form weight units are shown compressed to their minimum internal volume;

FIG. 1A is a plan view of one of the two rigid plate members that accommodate an end of the crossbar of the dumbell or barbell;

FIG. 2 is a view like that of FIG. 1 but showing the bellows-form weight containers expanded to their maximum volume capacity;

DETAILED DESCRIPTION OF PREFERRED EMBODIMENTS

Figure 3:
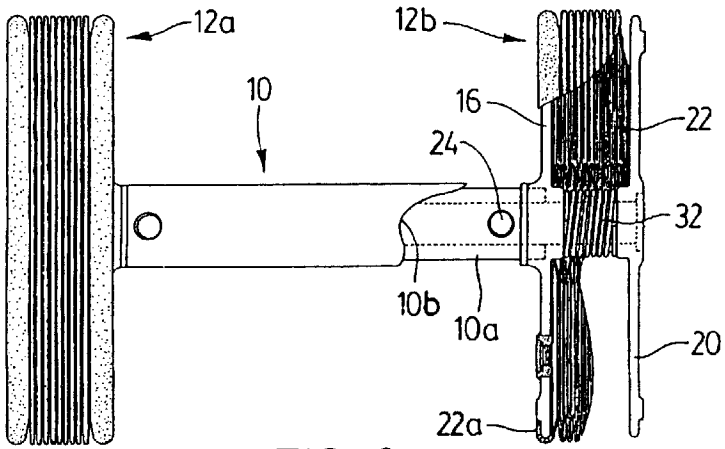
FIG. 3 is a further view of the dumbell of FIG. 1, but with exterior of the weight container and of the outer covering of the crossbar partly broken away to show the internal functioning components.

Turning now descriptively to the drawings, in which similar reference characters denote similar elements throughout the several views, FIG. 1 illustrates the exterior view of a dumbell including a crossbar 10 and identical bellows-form weight units indicated generally at 12*a* and 12*b*, each shown linearly compressed to its smallest volume. In FIG. 1, scale markers seen through apertures 14 on crossbar 10 indicate (for example) that in their compressed configuration each of the weight units 12*a* and 12*b* holds 5 lbs. of water when filled.

FIG. 2 is similar to FIG. 1 but with the bellows-form weight unit fluid containers 12*a* and 12*b* expanded to their maximum limit capacities, by way of example 30 lbs. each. In the minimum/maximum expansion views of the dumbell shown in FIGS. 3 and 4, respectively, the exterior of weight unit of 12*b* has been shown partly broken and partly in section to reveal the internal components, and the adjacent outer portion of crossbar 10.

In the illustrated embodiment, crossbar 10 comprises an inner, inflexible tubular main bar portion 10*a* made of aluminum, rigid plastic or the like and an outer tubular sheet 10*b* made of medium density rubber or like material to provide a desirable grip-coating for the crossbar.

Each weight unit comprises a first rigid plate member 16 having a central aperture 18 for receiving an end of crossbar 10, and second rigid plate member 20 in axial alignment with crossbar 10 and first plate member 16. These plates form an integral weight unit with flexible bellows-formed receptacle 22 which may be fabricated, for example, of a flexible silicone polymer including end portions 22*a* which outwardly overlap and cover face plates 16 and 20.

Figure 4A:
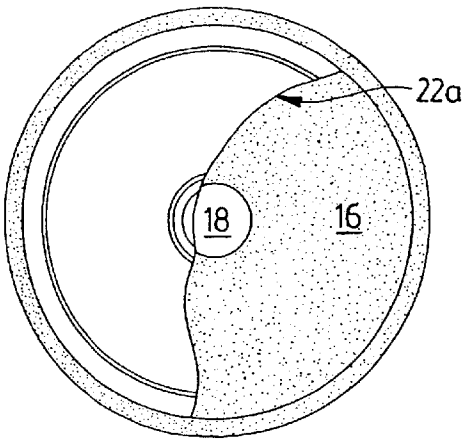
FIG. 4A is a view of the outer end plate of FIG. 1A seen in the direction of arrow A towards the partly broken away portion of FIG. 4.
Figure 4B:
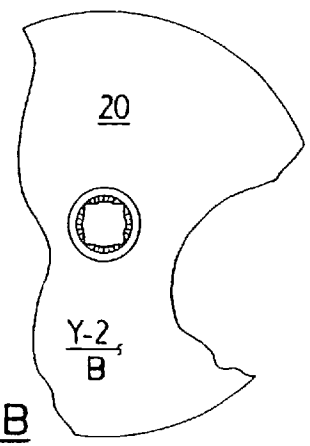
FIG. 4B is a partly broken away view of the inner end plate of the weight unit which includes the end plate of FIG. 3A, seen in the direction of arrow B in FIG. 4.
Figure 4:
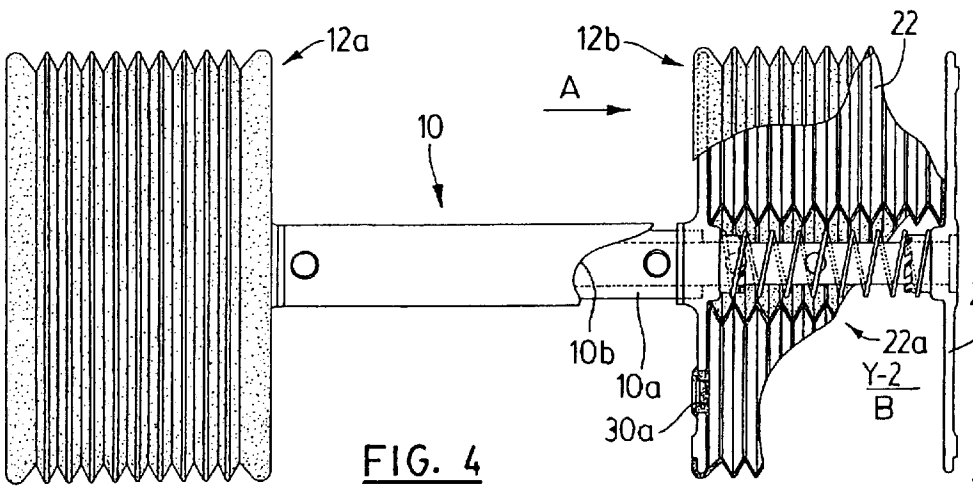
FIG. 4 is a partly broken away view like that of FIG. 3, but in which the bellows-form weight container is shown expanded to its maximum capacity.
Figure 5:
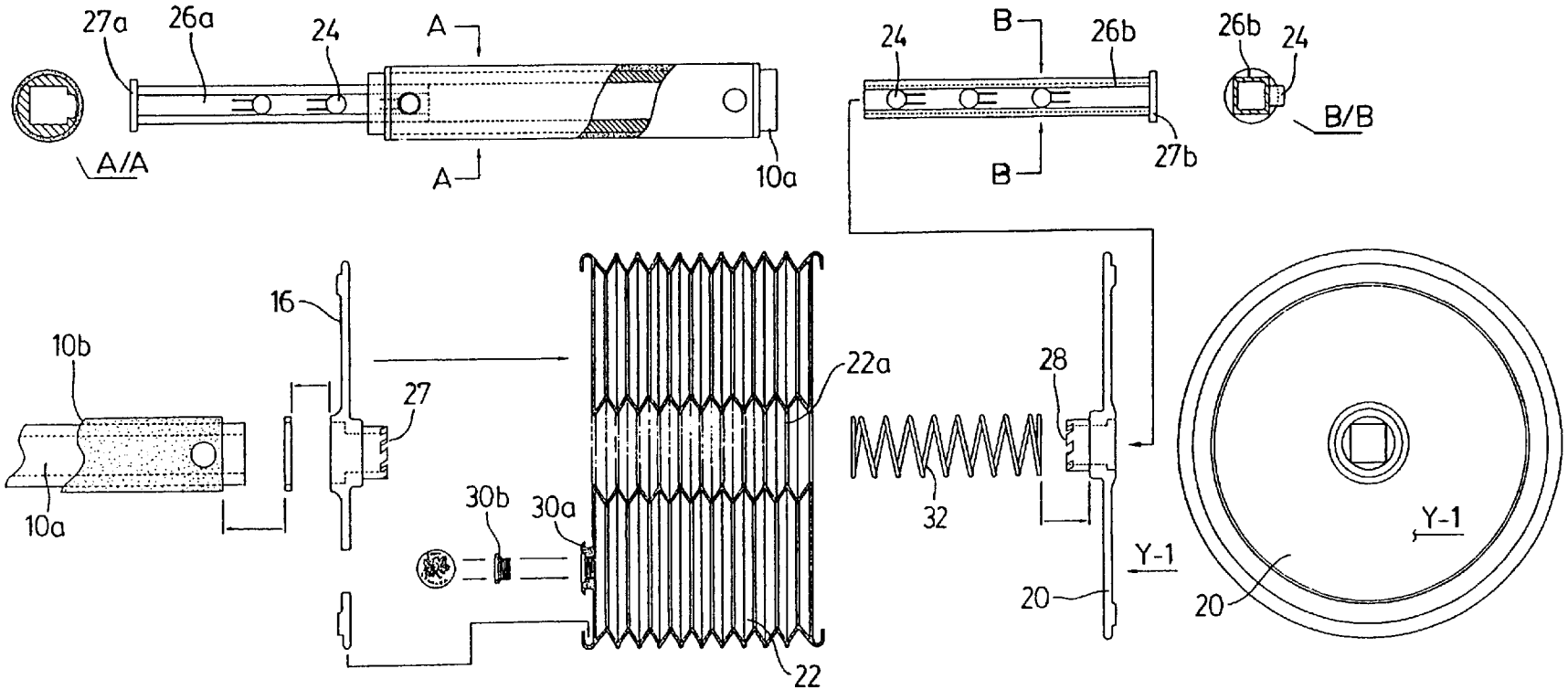
FIG. 5 is an exploded view illustrating components of an extendable crossbar arrangement which may in a preferred embodiment conveniently be used in conjunction with bellows-form weights according to the present invention.

As best seen in the partly broken away view of weight unit 12*b* in FIG. 4 and in the corresponding exploded view in FIG. 5, bellows-form is of generally annular cross-sectional configuration presenting a central longitudinal walled passage 22*a* which in the assembled dumbell is in axial alignment with crossbar 10 and the central aperture 18 through the two inner plates 16 of units 12*a* and 12*b*.

As superposed positions symmetrically inset from their opposite ends, hollow bar 10*a* and 10*b* include apertures 14 to accommodate and reversibly lock on to leaf-spring loaded buttons 24*a* on either of two bar inserts 26*a* and 26*b* which fits slidably within the interior channel of crossbar 10. The outer ends 27*a* and 27*b* of bar inserts 26*a* and 26 are in use respectively secured to corresponding outer end plates 20 of the two weight units. These slides/snap-lock interrelationship of bar inserts 26*a* and 26*b* to the inner bar 10*a* is best seen in the exploded view of FIG. 5. In FIG. 5 and in its cross-sectional view along directional arrow A, bar insert 26*a* is shown outwardly withdrawn to a snap-lock position corresponding to maximum expansion of the bellows of weight unit 12*a*.

The fully compressed position of a bellows 22 may optionally be releasably secured by means of locking tabs 27 and 28 formed on the inner faces of end plate 16 and 20 respectively, of the weight unit, best seen in the exploded view of FIG. 5. Locking tabs 27 and 28 are temporarily locked then released for use by opposite slight twisting motions of the ends of an emptied, fully compressed weight unit.

When a bellows is expanded or contracted to a desired calibration position, water is added through filling means. In the illustrated embodiment this is threaded filling port 30*a* with associated screw cap 30*b*.

It is also advantageous to include for each weight unit a compression spring 32 which nests within channel 22*a* and bears against the inner faces of plate members 16 and 20 to facilitate expansion of the bellows between successive space settings.

Together, a bellows, its front and end plates and its locking tabs may be removed from the crossbar with their respective bar inserts 26*a* and 26*b* for filling, emptying, storage or travel, simply by releasing the last (highest) weight setting, sliding the unit of the bar and emptying the bellows of fluid. The bar insert can then be removed from the bellows and packed into the interior of crossbar 10.

It will be seen from the foregoing that the novel use by the present invention of expanding/contracting bellows-formed fillable weights, in conjunction with step-up weight calibration bar locking means affords convenience, ease of use and portability significantly superior to adjustable weights in the prior art.

The invention is defined in the claims which follow and it will be appreciated that a number of obvious variants could be made without departing from the spirit and scope of the invention. For example, a heavy weight barbell made according to the invention need not be restricted to a single pair of bellows units at opposite ends of a bar. Additional weights could be included by multiple interlocking or separate units at each ends of the bar.

I claim:

1. An exercise dumbell, comprising:

(a) an elongate handle;

(b) at least one pair of adjustable weight units, each said weight unit comprising a first rigid plate member having a central aperture for receiving an end of said handle, a second rigid plate member, and a collapsible/expandible receptacle for fluid extending longitudinally between opposed faces of said first end second plate members;

(c) means for filling said receptacle with and emptying said receptacle of fluid;

(d) said means for filling said receptacle with and emptying said receptacle of fluid comprising a sealable filling/emptying port through one of said rigid plate members;

(e) means for releasably holding said first and second plate members of said weight unit at one of a number of predetermined longitudinal space settings coaxially with said handle, each said predetermined setting corresponding to a selected total weight of said weight unit when filled with water; and (f) calibration means for visually indicating the weight of a fluid-filled weight unit at each of said longitudinal space setting.

2. An exercise dumbell according to claim 1, wherein said collapsible/expandible receptacle is in the form of a resilient bellows.

3. An exercise dumbell according to claim 2, wherein the interior cavity of said bellows is of a generally annular cross-sectional configuration, with a central passage adapted to be aligned with said handle and said central aperture through the first rigid plate member of the weight unit.

4. An exercise dumbell according to claim 3, wherein said elongate handle is a hollow cylindrical bar with a longitudinal interior channel, and said means for releasably holding said first and second plate members of said weight unit at a number of predetermined settings comprises:

(i) an elongate bar insert centrally mounted at one end thereof to said second rigid plate member and extending axially through said central passage of said bellows into said longitudinal interior channel of the handle; and (ii) a linear array of outwardly sprung locking members, and a cooperating locking recess through the wall of the handle, the releasable mating of any one of said locking members with said locking recess corresponding to a selected one of said longitudinal space settings.

5. An exercise dumbell according to claim 3, further comprising compression spring means positioned in said central passage through the bellows for urging said first and second plates of the weight unit apart to facilitate expansion of the bellows between successive longitudinal space settings.

6. An exercise dumbell according to claim 4, wherein said calibration means comprises a numerical scale of weight along the outside of said elongate bar insert and a sight port through said elongate handle for viewing a weight reading at each of said longitudinal space settings.

7. An exercise dumbell according to claim 4, wherein said substantially sprung locking members are leaf-spring loaded pushbuttons and said cooperating locking recess is a circular hole through the wall of said elongated handle.

8. An exercise dumbell according to claim 1, wherein opposed faces of said first and second rigid plate members present mating locking tabs for releasably securing the plates together when the dumbell is disassembled for storage.

* * * * *